United States Patent [19]

Scott, Jr.

[11] 4,022,463

[45] May 10, 1977

[54] SPRING TYPE EXERCISING DEVICE

[75] Inventor: George T. Scott, Jr., Lubbock, Tex.

[73] Assignee: Elmer's Weights, Inc., Lubbock, Tex.

[22] Filed: Nov. 14, 1975

[21] Appl. No.: 631,860

[52] U.S. Cl. ..... 272/136; 272/142

[51] Int. Cl.[2] ..... A63B 21/32

[58] Field of Search ..... 272/136–138, 272/140–142, 100–108, 143, 134

[56] References Cited

UNITED STATES PATENTS

| | | | |
|---|---|---|---|
| 2,106,994 | 2/1938 | Chapman | 272/137 |
| 2,132,862 | 10/1938 | Dilates | 272/83 R |
| 2,529,347 | 11/1950 | Mohler et al. | 272/137 |
| 3,349,621 | 10/1967 | Mullen | 272/83 R X |
| 3,366,381 | 1/1968 | Ross | 272/59 C |
| 3,759,512 | 9/1973 | Yount et al. | 272/58 |
| 3,768,808 | 10/1973 | Passera | 272/83 R X |
| 3,920,241 | 11/1975 | Belkir | 272/83 R |

*Primary Examiner*—Richard J. Apley
*Assistant Examiner*—William R. Browne
*Attorney, Agent, or Firm*—Wendell Coffee

[57] ABSTRACT

An exerciser particularly adapted for the groin muscles or the chest muscles has a stand adjustable in height. A crossbar at the top of the stand carries two pivoted arms having pivoted pads on one end and one or more springs on the other. To exercise the groin, an athlete is seated before the device, places his feet on the base of the stand and his knees against the pads to compress them against the tension of the springs. To exercise chest muscles, the stand is placed upon a table and the arms at about the elbows are placed upon the pads and they are pushed inward against the springs.

4 Claims, 5 Drawing Figures

SPRING TYPE EXERCISING DEVICE

BACKGROUND OF THE INVENTION

1. Field of the Invention

This invention relates to spring resisting push pull type exercising devices.

2. Description of the Prior Art

In athletic endeavors, particularly contact sports, the pull and strain of groin muscles is a problem. It is desirable to provide a compression exercising device to exercise the chest by being pushed together by the elbows. Previously, devices to exercise the groin and chest muscles were unsupported except for the athlete. I.e., they did not rest upon the floor or a table while being used. Also, they were primarily characterized by the inward pressure being resisted by compression springs and the two elements of the device being pushed together.

Applicant was aware of the following patents at the time of preparing this patent application:

| | |
|---|---|
| Chapman | 2,106,994 |
| Kasulis | 3,174,343 |
| Oesau | 3,355,171 |
| Barrett | 3,544,106 |
| Huber | 3,561,758 |
| Krauth | 3,633,908 |

SUMMARY OF THE INVENTION

New and Different Function

I have invented an exercise device primarily adapted for exercising the groin muscles; it is also adapted for exercising the chest muscles.

To exercise the groin mucles, the device is supported on the floor and the athlete seated facing the device places his feet upon the base plate of the stand so the inside of his knees make contact with the pads. Then, he presses his knees together against the tension of the springs attached to the arms of the pads at the opposite end, thus tightening and strengthing the thigh muscles of the athlete.

To exercise the chest muscles, which is often recommended after many types of chest surgery as well as being desireable in general physical development, the device is placed upon a table. The person stands facing the device, encompassing the device with his arms so the pads are positioned on the inside of the arms at about the elbows, the elbows forced inward against the tension of the springs and, thus, tightening and strengthing the musccles of the arms, chest and shoulders. An alternate chest exercise is to cross the arms and grasp the pads with the hands.

The stand makes the exerciser self storing. I.e., no special storage facilities are needed and it is readily moved from one place of use to another.

Objects of the Invention

An object of this invention is to provide an exercise device for the groin muscles or the chest muscles.

Other objects are to achieve the above with a device that is sturdy, compact, durable, lightweight, simple, safe, efficient, versatile, and reliable, yet inexpensive and easy to manufacture, store, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
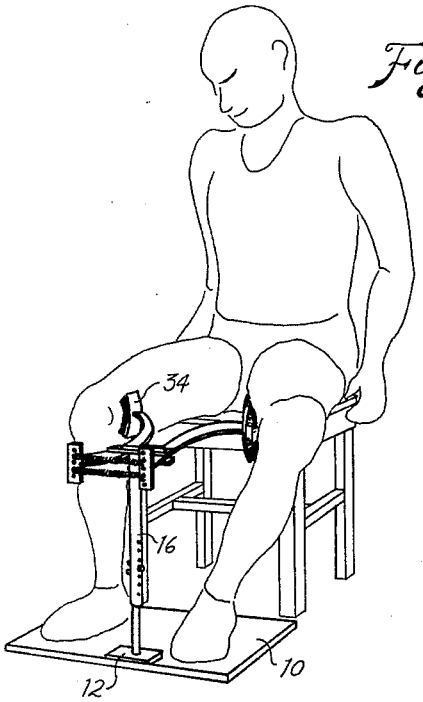
FIG. 1 shows a seated athlete using an exerciser according to this invention.
Figure 2:
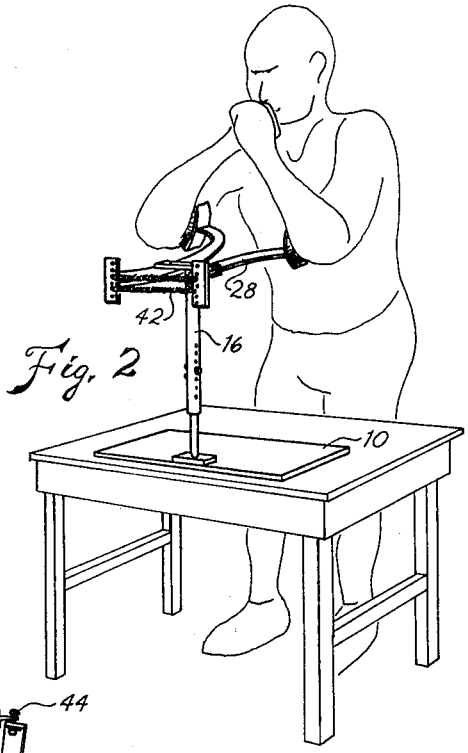
FIG. 2 shows a person using the exerciser for chest exercises.
Figure 3:
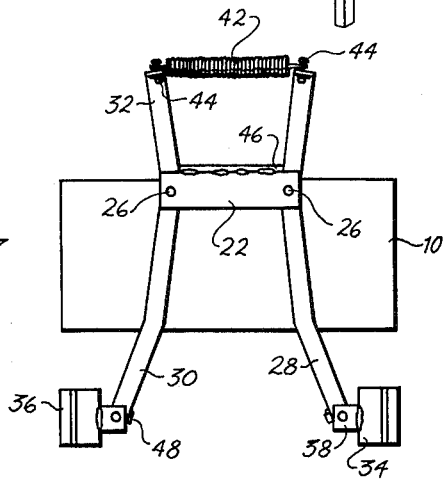
FIG. 3 is a top plan view of the exerciser.
Figure 4:
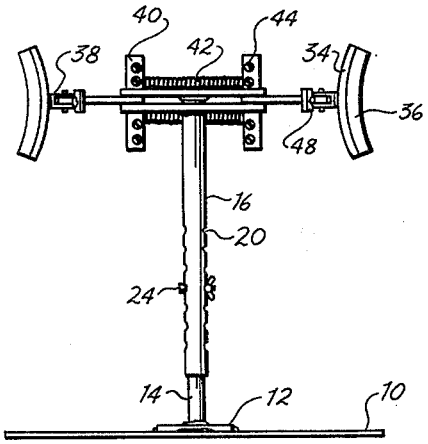
FIG. 4 is a front elevational view thereof.
Figure 5:
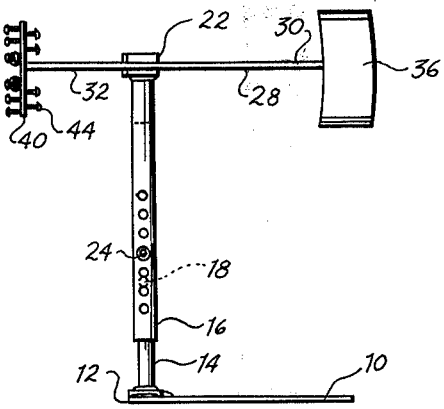
FIG. 5 is a side elevational view thereof.

Referring to the drawing, there may be seen the exerciser mounted upon a stand. This stand includes base plate 10. The base plate is adapted for an athlete to place his feet thereon if used as a groin exerciser. A pintle rises from the base plate. I have found it convenient to use a b 12 × 24 inch metal plate for the base plate. The pintle is attached near one of the long edges of the base plate at the center of one of the long sides as illustrated.

I find it convenient to attach a small plate or boss 12 to the base plate and attach tube or rod 14 to the boss 12. Tube 16 telescopes over the rod 14. Three holes 18 are placed near the top of the rod 14 and seven holes 20 near the lower portion of the tube 16. The spacing between the holes in the rod are not the same as the spacing between the holes in the tube; therefore, the holes form a vernier or they are vernier arranged so the height of crossbar 22 on top of the tube 16 may be adjusted to any desired height. As the crossbar is on top of the tube 16, it might be also described as being on top of the pintle.

Pin 24 in the form of a short bolt with a thumb screw inserted through a pair of the holes 18 and 20, holds the crossbar at the desired height.

The crossbar is formed of two horizontal bars, one being slightly above the other so there is a space between the two crossbars 22. On the end of the crossbars there is pivot 26 formed by a vertical pivot bolt.

Arm 28 is pivoted to each of the pivots 26. Each arm has pad end 30 and spring end 32.

A pad is formed by arcuate plate 34. I find it desirable to form cushion 36 on the front or concave side of plate 34 from a resilient material such as sponge rubber. The back or convex side of each of the plates 34 has a pair of ears 38 which straddle the pad end 30 of the arm. The ears 38 are held in place with a pad pin. Therefore, it may be seen that the pads themselves are pivoted to the pad end of the arms.

Vertical or upright oriented header 40 is attached to each of the spring ends 32 of the arms 28. As may be seen, the spring end and pad end are on opposite sides of the pivot 26. Each header 40 has ten studs 44 extending therefrom. At least one tension spring 42 is attached from the stud 44 of one header to stud 44 of the opposite header.

Stops 46 are attached through the crossbars 22. The stop pin 46 limits the inward travel of the spring ends 32 and, thus, the outward travel of the pads. Stop 48 on each arm 28 adjacent ear 38 prevents the pads from flopping.

As indicated previously to use the device as a groin exerciser, the athelete is seated in front of the device with his feet upon the base plate 10. The height of the crossbar is adjusted by inserting pin 24 through a pair of the holes 18 and 20 so the arms 28 are aligned with the thighs. The thighs at about the knees are placed against the cushions 36 and the knees pressed inward against the pads. Obviously, the tension of the spring or springs 42 resist the inward movement of the pad ends. Normally, a plurality of springs would be attached at the spring end.

To use the device to exercise the chest muscles, the base plate is placed upon a table and the person stands before it. The height of the crossbar is adjusted, placing the pin 24 through the desired pair of holes 18 and 20. Then, the upper arms are placed at about the elbows against the cushions 36 of the pads and the elbows moved together against the resistance of the tension springs 42. It will be understood that, normally, two springs would be used for exercising the chest muscles and more for the groin muscles. As muscles strengthen, additional springs may be added as desired.

As an aid to correlating the terms of the claims to the exemplary drawings, the following catalog of elements is provided:

| | |
|---|---|
| 10 base plate | 30 pad end |
| 12 boss | 32 spring end |
| 14 rod | 34 plate, pad |
| 16 tube | 36 cushion |
| 18 holes, rod | 38 ears |
| 20 holes, tube | 40 header |
| 22 crossbar | 42 tension spring |
| 24 pin | 44 studs |
| 26 pivot | 46 stop |
| 28 arm | 48 stop |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. An exerciser comprising:

a. a base plate adapted for an athlete to place his feet thereon,
b. a pintle attached to the base plate,
c. a horizontal crossbar on the pintle,
d. a pivot on each end of the crossbar,
e. a horizontal arm pivoted to each pivot,
f. each arm having a padded end and a spring end on opposite sides of the pivot,
g. pads on each of the pad ends adapted to have the athlete place his knees thereon to push the pads together, and
h. at least one tension spring,
j. the ends of the spring attached to the spring end of the arms,
k. so that the spring resists the inward movement of the pads and thus the knees of the athlete, and
m. said pads pivoted to the arms by an upright pin in a bifurcation on the pad.

2. The invention as defined in claim 1 with additional limitations of m. an upright header attached to each of the spring ends of the arms,
n. a plurality of studs on the header,
o. said spring and at least one additional spring extending from one header to the other.

3. The invention as defined in claim 1 wherein said pintle includes:

m. a rod telescoped in a tube,
n. one of which is attached to the base plate and the other of which is attached to the crossbar,
o. a plurality of holes in the rod and tube arranged in a vernier relationship, and
p. a pin through a pair of the holes.

4. The invention as defined in claim 3 with additional limitations of q. an upright header attached to each of the spring ends of the arms,
r. a plurality of studs on the header,
s. said spring and at least one additional spring extending from one header to the other.

* * * * *